United States Patent [19]

Harmathy

[11] 3,968,841

[45] July 13, 1976

[54] FLAME DEFLECTING DEVICE FOR MOUNTING ON A BUILDING EXTERIOR

[75] Inventor: Tibor Z. Harmathy, Ottawa, Canada

[73] Assignee: Canadian Patents and Development Limited, Ottawa, Canada

[22] Filed: June 4, 1975

[21] Appl. No.: 583,518

[52] U.S. Cl. ..... 169/48; 169/42

[51] Int. Cl.[2] ..... A62C 7/00

[58] Field of Search ..... 169/48, 49, 50, 51, 169/57, 42; 49/1–7; 160/1–9, 19, 45; 52/69, 73

[56] References Cited

UNITED STATES PATENTS

| | | | |
|---|---|---|---|
| 461,857 | 10/1891 | Tufts | 49/7 |
| 1,243,690 | 10/1917 | Blauvelt | 169/42 |
| 1,913,725 | 6/1933 | Schweig | 49/7 |
| 1,953,582 | 4/1934 | Belknap | 169/42 |
| 2,535,368 | 12/1950 | Norcross | 49/7 |

*Primary Examiner*—John J. Love
*Attorney, Agent, or Firm*—Francis W. Lemon

[57] ABSTRACT

A flame deflecting device for mounting on a building exterior comprises a panel which is attached by hinges at its lower end to extend upwardly along the face of the building between windows at different levels. A releasing device, preferably actuated by flames from the lower window, releases the panel so that is falls to extend substantially horizontally to deflect flames, escaping from the lower window, from the upper window thus retarding the spread of fire while allowing the fire causing the flames from the lower window to rapidly burn out. The releasing device may be a heat destructible fastening element holding the panel against a compression spring on a stud fixed to the wall of the building.

5 Claims, 6 Drawing Figures

FLAME DEFLECTING DEVICE FOR MOUNTING ON A BUILDING EXTERIOR

Figure 1:
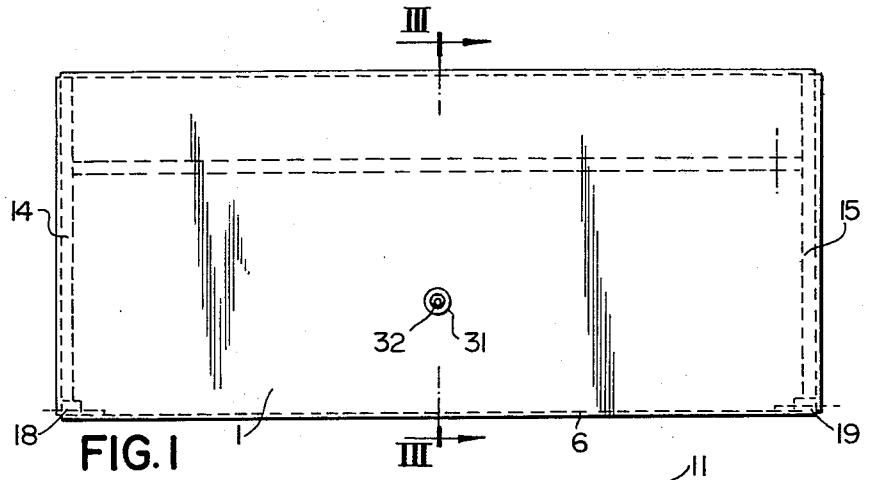

This invention relates to a flame deflecting device for mounting on a building exterior.

For several decades the philosophy of fire protection of buildings has been founded on two postulates. One is related to the nature of fire, the other to the mode of fire spread. With respect to the nature of fire, it has been assumed that the severity of compartment fires depends solely on the amount of combustible materials present. With respect to the fire spread, it has been claimed that the spread occurs either (i) by conduction of heat through the boundaries of the compartment on fire, followed by the ignition of combustibles in the neighbouring spaces; or (ii) by collapse or partial failure of one or more elements of the compartment boundaries and subsequent penetration of flames into the adjoining spaces. Consequently, to check the spread of fire, the boundary elements of all constituent building spaces have been required to exhibit specified "fire resistances", that is proven abilities to resist heat conduction and structural damage for specified periods.

The fallacy of the concept that the amount of combustible materials is the only important factor that determines the severity or potential fires, has been known for many years. As discussed in a recent paper "Design Approach to Fire Safety in Buildings", Progressive Architecture, April 1974, pages 82 to 87, by T. Z. Harmathy, the flow of fresh air into the compartment, in other words, the "ventilation" of the compartment, is an equally important factor. Naturally, if there is no ventilation at all, the fire cannot fully evolve and will die out after the oxygen supply is exhausted. In reality, however, the ventilation is rarely zero even if the compartment has no windows. The characteristics of the fire are most adverse just in the regime of low ventilations which usually occur if the windows are small. In this regime the fire often attains very high temperatures and, without human intervention, burns for a long time. At increasingly larger ventilations, that is at increasingly larger window areas, both the temperature of the fire and its duration gradually decrease.

The fallacy of the second postulate, namely that fire spreads either by heat conduction through or by the structural failure of the boundary elements of the compartment on fire, is also well known to fire experts. The flames are driven by pressure differences from one space to another either horizontally, usually through a door left open by the escaping tenants, or vertically from window to window along the facade of the building.

Obviously, the value of relying on well insulated "fire resistant" compartment boundaries as the basic protection measure, is highly illusory. Other measures, often suggested but rarely employed, include the use of shutters, curtains or boards automatically released to close off door or window openings in the case of fire. Such devices have been described by C. R. Bumbarger (U.S. Pat. No. 1,369,518, Feb. 22, 1921) and Voiturier et al (U.S. Pat. No. 3,837,126, Sept. 24, 1974). Admittedly, if these devices could completely seal off the fire cell, they were able to terminate the fire. Yet, using them is not without any danger. There is usually sufficient leakage area along the boundaries of the compartment to allow the penetration of some air and the departure of the combustion products formed. As pointed out earlier, the most adverse conditions, namely the highest temperatures and longest fire durations, are expected to arise exactly at such deficient ventilations. It is well known that fires developing in poorly ventilated spaces, for example in basements, theatres, ships, etc., are the most destructive ones.

Furthermore, using such shutters, curtains or boards is regarded by many as highly undesirable because they may hinder the escape of the occupants of the fire compartment, as well as the fire fighting operations.

It is clear by now that a higher degree of fire safety can be achieved by the application of the following philosophy. Once fire has broken out in a compartment, it is wiser to resign to the loss of the contents of this compartment and concentrate all efforts to ensure that (i) the temperature in the fire cell remains low and the fire duration short, and (ii) the fire will not spread to other compartments via the usual routes.

The former objective is achieved by allowing air to enter freely into the compartment, in other words, by not hindering the breakage of the windows and not restricting in any way the flow of fresh air through them. To achieve the second, the two main routes of fire spread have to be cut off. As mentioned earlier, these are: doors left open by the escaping tenants and windows which permit the flames to climb from storey to storey along the building facade.

Preventing the doors from being left open is clearly a simple problem, and can be solved by the use of self-closing doors, preferably weight-operated sliding doors. Intercepting the climb of the flames along the facade is a more complex one, since, as emphasized before, this should be done without blocking the window openings.

It was believed earlier that horizontal projections of at least 2 ft wide, built above the windows, could provide sufficient protection against the spread of fire vertically from window to window. A few tests performed in Britain indicated, however, that 2-ft projections are inadequate. After passing such a narrow projection, the flames curl back to the face of the building and may cause the breakage of windows and ignition of combustibles on the storey above.

Some further experiments conducted in Australia clearly showed that, to provide some protection, the projection must be at least 3 ft wide, preferably 4 ft or more if the fire is expected to be very severe. Such wide projections not only keep the flames away from the face of the building, but also cut down the radiation hazard to an acceptable level.

Obviously, continuous balconies and open corridors are very useful devices in protecting buildings against massive fires. Unfortunately, open corridors are rarely used nowadays. Balconies are still popular in apartment buildings, but they are generally built in smaller units, designed to serve only one or two apartments. The dislike for continuous balconies is understandable. They not only cut down the natural daylight reaching the interior, but also substantially increase the cost of the building, and often produce aesthetically undesirable effects.

Even though isolated balconies are very beneficial from the point of view of facilitating the rescue of the occupants, their role in protecting the building against the vertical spread of the flames is obviously limited.

It would be desirable to provide a flame deflecting device, for mounting on a building exterior, which will not cut down the natural daylight reaching the building interior but which, in the event of a fire at the lower of the two levels, is actuated to deflect flames from the or each window immediately below the device from the or each window immediately above the device while leaving the or each lower window free for the entry of air.

It is an object of the present invention to provide a flame deflecting device, for mounting on a building exterior, which will not cut down the natural daylight reaching the building interior but which, in the event of a fire at the lower of the two levels, will deflect flames escaping from the or each window immediately below the device from the or each window immediately above the device while leaving the or each lower window free for the entry of air.

It would also be desirable to provide a flame deflecting device for mounting in an upwardly extending position between windows at different levels, and which may be thermally actuated to extend in a substantially horizontal position to deflect flames, escaping from the lower window, from the upper window.

It is a further object of the present invention to provide in some embodiments a flame deflecting device for mounting in a upwardly extending position between windows at different levels, and which may be thermally actuated to extend in a substantially horizontal position to deflect flames, escaping from the lower window, from entering the upper window.

According to the present invention there is provided a flame deflecting device for mounting on a building exterior, comprising:

a. a fireproof and weatherproof panel for mounting in an upwardly extending position on a side portion of a building exterior, extending between adjacent windows at different levels, and with the panel extending in a horizontal direction beyond the extremities of the said adjacent windows and in an upward direction extending at least three feet, b. mounting means, attached to the panel, for pivotally mounting the panel on the side portion of a building exterior in the upwardly extending position, so that the panel may turn from the upwardly extending position to a substantially horizontally extending position, c. holding means by which the panel is held against turning any further than the substantially horizontally extending position, and d. securing means releasably securing the panel in the upwardly extending position, and whereby, e. when the panel is thus mounted, held and secured in the upwardly extending position to a portion of a building exterior, the securing means may be actuated for the panel to turn to the substantially horizontally extending position to deflect flames issuing from a window immediately beneath the panel from an adjacent window immediately above the panel.

Figure 2:
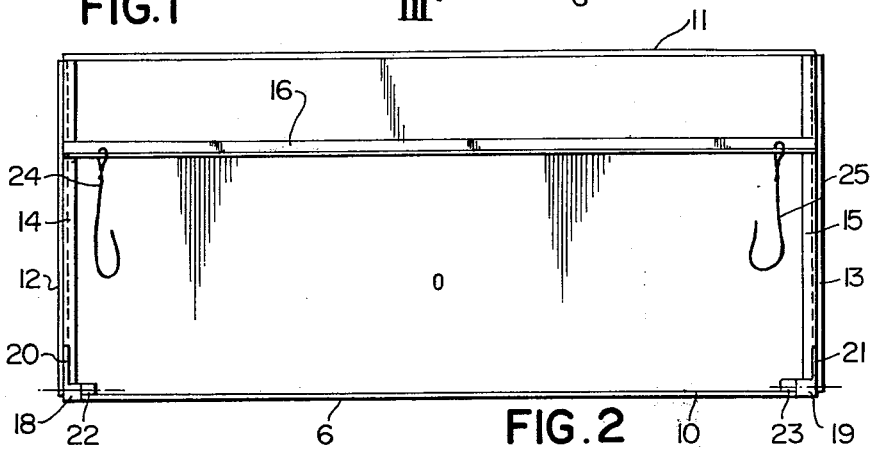
Figure 3:
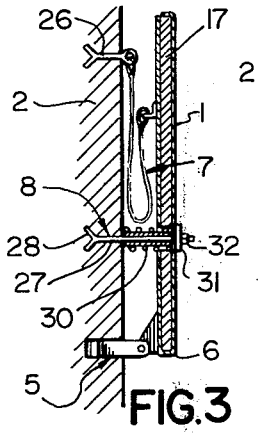
Figure 4:
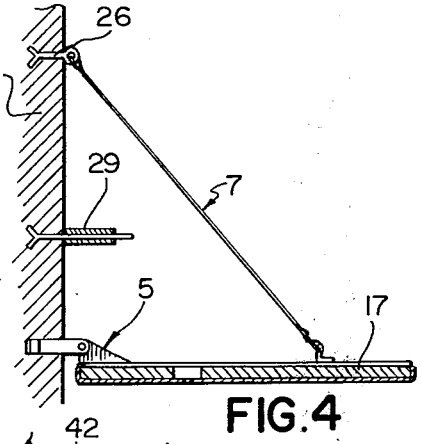
Figure 6:
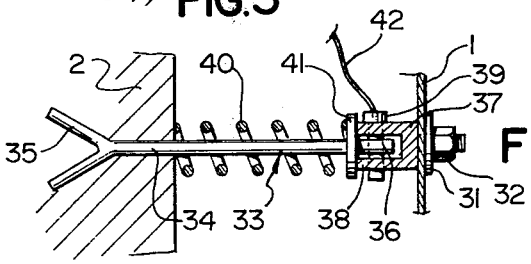
Figure 5:
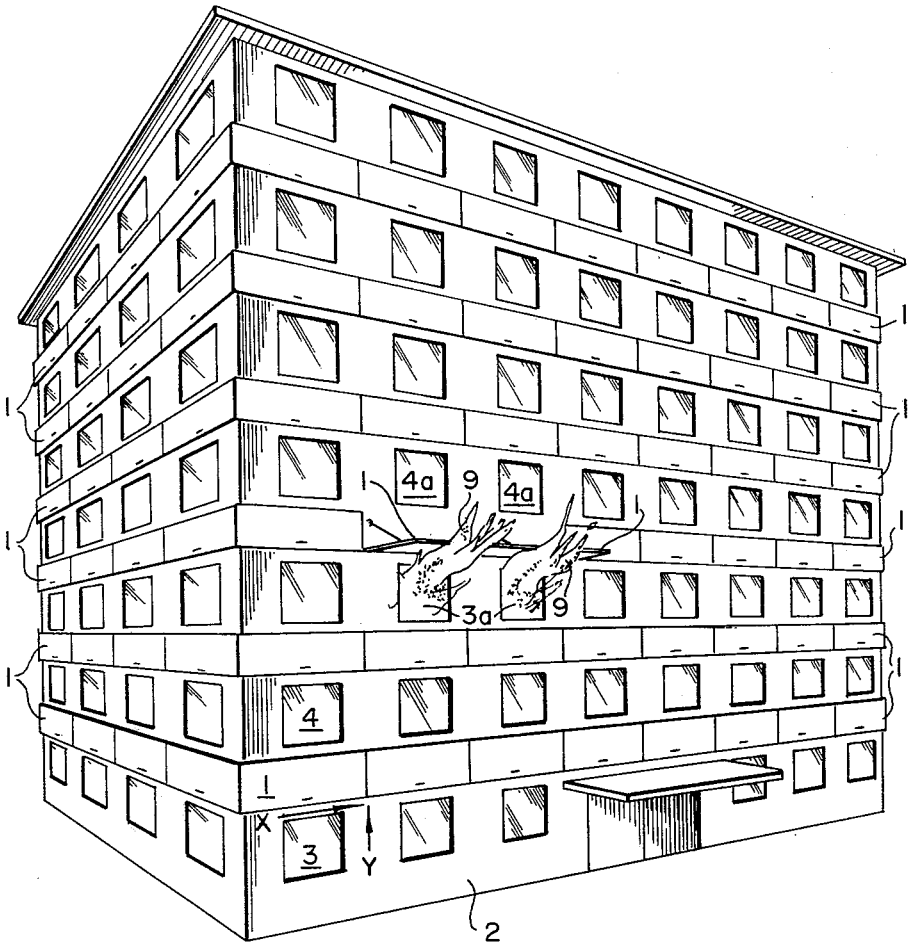

In the accompanying drawings which illustrate, by way of example, embodiments of the present invention, FIG. 1 is a side view of a flame deflecting device, for mounting on a building exterior, viewed from the front when in an upwardly extending position, FIG. 2 is a side view of the flame deflecting device shown in FIG. 1, in the upwardly extending position and viewed from rear, FIG. 3 is a partly sectioned end view along III—III, FIG. 1, with the flame deflecting device in the upwardly extending position, FIG. 4 is a similar, partly sectioned end view to that shown in FIG. 3, but with the device in the substantially horizontally extending position, FIG. 5 is a perspective view of a building with flame deflecting devices of the type shown in FIGS. 1 to 4 mounted thereon, and FIG. 6 is a partly sectioned side view of a portion of a flame deflecting device, for mounting on a building exterior, similar to that shown in FIGS. 1 to 4.

Referring now to FIGS. 1 to 5, there is shown a flame deflecting device for mounting on a building exterior, comprising:

a. a fireproof and weatherproof panel 1 for mounting in the upwardly extending position, as shown in FIG. 1 to 3, to a side portion of a building exterior 2, extending between adjacent windows at different levels, such as windows 3 and 4, with the panel 1 extending in a horizontal direction X (FIG. 5) beyond the extremities of the adjacent windows, such as windows 3 and 4, and in an upward direction Y extending at least 3 feet, b. mounting means, generally designated 5 in FIGS. 3 and 4, attached to the panel 1, and for pivotally mounting the panel 1 on the side portion of a building exterior 2 in the upwardly extending position shown in FIGS. 1 to 3, such that the panel 1 may be turned, with the lower end 6 (FIGS. 1 to 3) remaining adjacent the building exterior 2, from the upwardly extending position shown in FIGS. 1 to 3 to the substantially horizontally extending position shown in FIG. 4, c. holding means, generally designated 7 (FIGS. 3 and 4), by which the panel 1 is held against turning any further than the substantially horizontally extending position, and d. securing means, generally designated 8 (FIG. 3), releasably securing the panel 1 in the upwardly extending position, and whereby, e. when the panel 1 is thus mounted, held and secured in the upwardly extending position, as shown in FIG. 3, to a portion of the building exterior 2, the securing means may be actuated to turn the panel 1 to the substantially horizontally extending position shown in FIGS. 4 and 5, to deflect flames 9 issuing from a window 3*a* immediately beneath each panel 1 from an adjacent window 4*a* immediately above each panel 1.

In this embodiment the panel 1 shown in FIGS. 1 to 5 is fabricated from light-gauge metal sheet, and in the FIGS. 1 to 5 some panel dimensions are exaggerated to facilitate illustration. As stated above, the or each panel 1 (FIG. 5) extends in the horizontal direction X (FIG. 5) beyond the extremities of the adjacent windows, such as windows 3 and 4, and this is done to retard the flames 9 from curling back around the sides of a panel 1. Further, the or each panel 1 extends in the upward direction Y (FIG. 5) at least 3 feet to retard the flames 9 from curling back, when panel 1 is lowered, around the outer side of panel 1 to the window 4*a*. If desired, the edges of the metal sheet forming the panel 1 (FIGS. 1 to 4) may be stiffened by, for example, bending the metal sheet edges at 90° to form sides 10, 11, 12 and 13, and possibly welding the sheet edges together at the corners. The metal sheet may be further stiffened by two light angles 14 and 15 welded or otherwise fastened thereto. A light angle or tee, in this embodiment angle 16, is welded to the angles 14, and 15. The space between the panel 1 and angle 16 may be filled or lined with a heat insulating material such as an asbestos or plaster board 17 (FIGS. 3 and 4), enclosed in a weatherproof cover to prevent rain damage or moisture penetration.

The mounting means, generally designated 5 (FIGS. 3 and 4), comprises two hinges 18 and 19 (FIGS. 1 and 2), each having one part 20 and 21 welded to the angles 14 and 15, respectively. The hinges 18 and 19 have the other part 22 and 23, respectively, embedded in the wall 2 of the building.

The holding means, generally designated 7, comprises two light cables 24 and 25 (FIG. 2), each fastened at one end through a hole in the angle 16 and at the other end to an eye, one of which is shown and designated 26 (FIG. 3), secured to the wall 2.

The securing means, generally designated 8 (FIG. 3), comprises a stud 27 secured to the wall 2 by a bifurcated inner end 28. In the embodiment shown in FIGS. 3 and 4 the stud 27 has a screw threaded outer end extending through an oval hole in the panel 1, a sleeve 29 around the stud 27 and abutting the wall 2 at one end and the panel 1 at the other end to locate the panel 1 in the upwardly extending position, a compression spring 30 around the sleeve 29 and compressed between the wall 2 and the panel 1, a washer 31 on the portion of screw threaded end of the stud 27, protruding through the panel 1, and a heat destructible, threaded nut or other fastening device 32, screwed or otherwise fastened on to the end of the stud 27 to clamp the panel 1 against the sleeve 29.

The washer 31 is preferably of a heat insulating material in order to prevent undue loss of heat from the nut 32 to the panel 1 when heated by the flames.

The heat destructible, threaded nut or other fastening device, 32, may be made heat destructible by being of a low melting-point alloy or of a combustible material that burns away when exposed to flames.

In operation a plurality of panels 1 are mounted, in the manner shown in FIG. 3, to the exterior 2 of a building as shown in FIG. 5.

Should a fire occur on, say, one floor of the building and flames, such as flames 9, issue from windows **3*a* then the heat from the flames 9 will destroy the or each fastening device 32 immediately above the flames 9 either by, say, melting or burning it. When the or each fastening device immediately above the flames 9 is destroyed, the panel 1 secured thereby is released and urged by its associated compression spring 30 off its stud 27 to swing by its hinges 18 and 19 to the substantially horizontally extending position shown in FIGS. 4 and 5. The or each panel 1 is held in the substantially horizontally extending position by the holding means 7**.

As stated above, the dimensions of the panel 1 retard the flames 9 from curling back, when in a horizontal position, around the panel 1 to the window **4*a*** thereabove.

The or each panel 1 is now exposed to the flames 9. However, the flame temperature rarely exceeds 1400°F. Since the panel 1 is cooled from the top by air currents, its average temperature can be expected to not normally riser higher than 800° to 900 °F. Although at these temperatures the strength of the panel 1, if it is made of sheet steel, is still considerable, unduly large temperature variations will undoubtedly result in substantial warping. The angle 16 welded to the angles 14 and 15 and spaced some distance from the panel 1 will, under normal conditions, remain well below 500°F and thus prevent the warped panel 1 from collapsing.

The use of the asbestos or plaster board filling 17 is only desirable if, judging from the fire load and ventilation conditions, the fire is expected to be long and hot. The main purpose of using the asbestos or plaster board filling 17 is to cut down thermal radiation from the panel 1 to the window **4*a* (FIG. 5) above the panel 1**.

The panel 1 is preferably surfaced with a coating, for example a baked-on enamel. The designer may select a colour for the coating that matches the other surfaces of the building 2 (FIG. 5) and blends therewith. However, contrasting colours or imprinted surfaces may be employed so that the panel 1 forms decorative elements.

Naturally, the problems of corrosion by the particular environment where the panel 1 is to be installed, has to be taken into account in selecting the materials or finishes for all of the components of the flame deflector.

The flame deflector shown in FIGS. 1 to 5 is preferably mounted with the panel 1 in the range 2 to 6 inches from the building exterior 2 (FIG. 5). The flame deflector shown in FIGS. 1 to 5 can be installed without too much difficulty on most existing buildings. If, however, it is found that there is an insufficient gap between the windows **3*a* and 4*a* (FIG. 5) then the panel 1 may be in two halves which are hinged together at their upper edges and the hinges spring loaded so that halves of the panel 1** will unfold to the substantially horizontal position when released.

Instead of compression spring 30 the panel 1 may have one or more counterweights on it to cause it to fall to the substantially horizontally extending position. Also, stops on the hinges 18 and 19, which support the panel 1 (FIG. 4) in the substantially horizontally extending position, may replace the holding means 7, provided the hinges 18 and 19 are sufficiently robust.

For a new building the designer may wish to modify the design of the flame deflector shown in FIGS. 1 to 5 to satisfy certain additional requirements concerned mostly with aesthetic effects. Thus, for example, in the case of newly designed buildings the designer may wish to mount the panels 1 to lie flush with the wall surface by securing them in recesses therein, and there are no practical difficulties in achieving this. In this respect it should be noted that the flame deflectors 1 (FIG. 5) form decorative girdles between floors, and although they may not be necessary, flame deflectors have been provided above the door on the ground floor for aesthetic reasons. Obviously no flame deflectors are needed above the uppermost windows.

The flame deflector shown in FIGS. 1 to 5 is for thermal activation by flames from the fire itself. However, it may be desirable under certain circumstances to activate a selected number of the flame deflectors manually, electrically, or by other means, even before these flame deflectors are reached by the flames, in addition to being activated by the flames or solely in this other manner. Thus the flame deflectors could be activated solely in response to a signal from a fire detector in the room below that flame deflector, or by a manually operated switch at a conveniently located emergency switch box, or in addition to being actuated by flames from the window below.

Manual or other actuation of the flame deflector shown in FIGS. 1 to 5 can easily be achieved by providing the fastening device 32 (FIG. 3) with an electrical heating coil which heats the threaded nut sufficiently to release the panel 1. In this instance the panel 1 may be released not only by flames from the window **3*a*** below, but also manually and/or by a fire detector as stated above.

In FIG. 6, similar parts to those shown in FIGS. 1 to 5 are designated by the same reference numerals and the previous description is relied upon to describe them.

In FIG. 6 the flame deflector is the same as the flame deflector shown in FIGS. 1 to 5 except that it has a differently designed securing means, generally designated 33. The securing means 33 comprises a stud 34 secured to the wall 2 by a bifurcated inner end 35 and having a hole 36 therethrough at the outer end. A forked stud 37, having a screw threaded outer end for the nut 32, is connected at the forked end 38 to the outer end of the stud 34 by means of a pin 39 extending through the hole 36. A compression spring 40 is compressed between the wall 2 and a washer 41 on the stud 34. A wire cable 42 is connected to the upper end of the pin 39.

In operation, the panel 1 in FIG. 6 may be actuated by the flames to assume the substantially horizontally extending position, in the same manner as the panel 1 shown in FIGS. 1 to 5, or it may be actuated by removing the pin 39 by means of the wire cable 42. The wire cable 42 may be pulled manually, electrically or by other means to remove the pin 39 and disconnect the stud 34 from the forked stud 37 and allow the compression spring 40 to urge the panel 1 to fall to the substantially horizontally extending position.

If desired the feature of a heat destructible, threaded nut 32 can be dispensed with by providing, say, a conventional threaded nut which will withstand the heat of the flames.

I claim:

1. A flame deflecting device mounted on a building exterior, comprising:

a. a fireproof and weatherproof panel in an upwardly extending position on a side portion of the building exterior extending between adjacent windows at different levels and with the panel extending in a horizontal direction beyond the extremities of the said adjacent windows and in an upward direction extending at least three feet, b. mounting means pivotally mounting the panel on the building exterior in the upwardly extending position, so that the panel may turn from the upwardly extending position to a substantially horizontally extending position, c. holding means by which the panel is held against turning any further than the substantially horizontally extending position, and d. securing means releasably securing the panel in the upwardly extending position, and whereby, e. when the panel is thus mounted, held and secured in the upwardly extending position to the portion of a building exterior, the securing means may be actuated for the panel to turn to the substantially horizontally extending position to deflect flames, issuing from the window immediately beneath the panel, from the adjacent window immediately above the panel.

2. A flame deflecting device according to claim 1, wherein the securing means releasably securing the panel is thermally actuated by flames from the lower of the adjacent windows for the panel to turn to the substantially horizontally extending position.

3. A flame deflecting device according to claim 2, wherein the thermally actuated securing means, releasably securing the panel, comprises a stud for securement to a wall, with its outer end extending through a hole in the panel, a compression spring on the stud for compression between the wall and the panel, and a heat destructible fastening element for clamping the panel on the stud.

4. A flame deflecting device according to claim 3, which includes a washer of heat insulating material on the stud for separating the panel from the fastening element.

5. A flame deflecting device according to claim 1, wherein the panel is lined with a heat insulating material.

* * * * *